US009948041B2

(12) United States Patent
Chen et al.

(10) Patent No.: US 9,948,041 B2
(45) Date of Patent: Apr. 17, 2018

(54) ELECTRICAL RECEPTACLE CONNECTOR FOR PROVIDING GROUNDING AND REDUCING ELECTROMAGNETIC INTERFERENCE

(71) Applicant: ADVANCED-CONNECTEK INC., New Taipei (TW)

(72) Inventors: Ching-Tien Chen, New Taipei (TW); Shu-Lin Duan, New Taipei (TW); Wei Wan, New Taipei (TW); Fu-Yi Xu, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 15/817,828

(22) Filed: Nov. 20, 2017

(65) Prior Publication Data

US 2018/0076582 A1 Mar. 15, 2018

Related U.S. Application Data

(62) Division of application No. 15/211,575, filed on Jul. 15, 2016, now Pat. No. 9,865,974.

(30) Foreign Application Priority Data

Jul. 16, 2015 (CN) ..... 2015 1 0417706

(51) Int. Cl.
*H01R 13/648* (2006.01)
*H01R 24/62* (2011.01)
(Continued)

(52) U.S. Cl.
CPC ..... *H01R 24/62* (2013.01); *H01R 13/6585* (2013.01); *H01R 13/6594* (2013.01)

(58) Field of Classification Search
CPC ..... H01R 13/6581; H01R 13/6582; H01R 13/6585; H01R 13/5687; H01R 24/64; H01R 13/6597
(Continued)

(56) References Cited

U.S. PATENT DOCUMENTS 9,379,494 B1 6/2016 Hu
9,647,369 B2 * 5/2017 Tsai ..... H01R 4/02
(Continued)

FOREIGN PATENT DOCUMENTS

CN 204391368 U 6/2015
TW M447000 2/2013
TW M534914 1/2017

*Primary Examiner* — Hae Moon Hyeon
(74) *Attorney, Agent, or Firm* — Muncy, Giessler, Olds & Lowe, P.C.

(57) ABSTRACT

An electrical receptacle connector includes a metallic shell, an insulated housing received in the metallic shell, receptacle terminals, and a grounding plate. The receptacle terminals and the grounding plate are at the insulated housing. The insulated housing includes a base portion and a tongue portion extending from the base portion. The grounding plate includes a plate body, extension arms, and contact regions. The front of the plate body is near to a front lateral surface of the tongue portion, and the rear of the plate body is extending to the base portion. The plate body is between the receptacle terminals. The extension arms are extending from the plate body. The contact regions are formed on the extension arms and in contact with an inner wall of the shell body. Accordingly, the grounding plate is in contact with the metallic shell for providing grounding and reducing the electromagnetic interference.

17 Claims, 16 Drawing Sheets

(51) Int. Cl.
*H01R 13/6594* (2011.01)
*H01R 13/6585* (2011.01)

(58) Field of Classification Search
USPC ..... 439/607.4, 660, 607.01
See application file for complete search history.

(56) References Cited

U.S. PATENT DOCUMENTS

| | | | | |
|---|---|---|---|---|
| 2015/0194770 | A1 | 7/2015 | Little | |
| 2015/0244111 | A1* | 8/2015 | Ju | H01R 13/6585 439/607.05 |
| 2015/0311645 | A1 | 10/2015 | Chang | |
| 2016/0013593 | A1 | 1/2016 | Kao | |
| 2016/0020568 | A1 | 1/2016 | Ju | |
| 2016/0118750 | A1 | 4/2016 | Guo | |
| 2016/0149350 | A1 | 5/2016 | Kao | |
| 2016/0197443 | A1* | 7/2016 | Zhang | H01R 13/6585 439/607.05 |
| 2016/0285209 | A1* | 9/2016 | Peng | H01R 13/6585 |
| 2016/0352050 | A1 | 12/2016 | Hu | |
| 2017/0018883 | A1* | 1/2017 | Chen | H01R 24/62 |
| 2017/0077652 | A1 | 3/2017 | Chen | |
| 2017/0085038 | A1* | 3/2017 | Duan | H01R 13/6585 |

* cited by examiner

| | | | | | | | | | | | | |
|---|---|---|---|---|---|---|---|---|---|---|---|---|
| GND | TX1+ | TX1− | VBUS | CC1 | D+ | D− | SBU1 | VBUS | RX2− | RX2+ | GND | 31 |
| GND | RX1+ | RX1− | VBUS | SBU2 | D− | D+ | CC2 | VBUS | TX2− | TX2+ | GND | 41 |

Fig. 9

ELECTRICAL RECEPTACLE CONNECTOR FOR PROVIDING GROUNDING AND REDUCING ELECTROMAGNETIC INTERFERENCE

CROSS-REFERENCES TO RELATED APPLICATIONS

This application is a Division of application Ser. No. 15/211,575, filed on Jul. 15, 2016, for which priority is claimed under 35 U.S.C. § 120; and this application claims priority of Application No. 201510417706.2 filed in China, P.R.C. on Jul. 16, 2015 under 35 U.S.C. § 119, the entire contents of all of which are hereby incorporated by reference.

FIELD OF THE INVENTION

The instant disclosure relates to an electrical connector, and more particular to an electrical receptacle connector.

BACKGROUND

Generally, Universal Serial Bus (USB) is a serial bus standard to the personal computer (PC) architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a conventional USB type-C electrical connector are totally different from those of a conventional USB electrical connector. A conventional USB type-C electrical receptacle connector includes a plastic core, upper and lower receptacle terminals held on the plastic core, and an outer iron shell circularly enclosing the plastic core. In addition, a shielding plate is disposed on the plastic core, and the shielding plate is between the upper receptacle terminals and the lower receptacle terminals.

SUMMARY OF THE INVENTION

The shielding plate is in the plastic core to prevent the signal interference between the upper receptacle terminals and the lower receptacle terminals. However, the shielding plate is not in contact with the outer iron shell so that the shielding plate fails to be grounded and to reduce the electromagnetic interference (EMI). Accordingly, how to improve the existing connector becomes an issue.

In view of this, an embodiment of the instant disclosure provides an electrical receptacle connector. The electrical receptacle connector comprises a metallic shell, an insulated housing, a plurality of first receptacle terminals, a plurality of second receptacle terminals, and a grounding plate. The metallic shell comprises a shell body and a receptacle cavity formed in the shell body. The insulated housing is received in the receptacle cavity. The insulated housing comprises a base portion and a tongue portion extending from one of two sides of the base portion. The insulated housing comprises a first portion and a second portion. The first portion is disposed on a top surface of the second portion. The first portion and the second portion are combined to form the base portion and the tongue portion. The second portion comprises two side walls, and the two side walls are respectively extending outward from two sides of the second portion. The first receptacle terminals are held at the insulated housing. The second receptacle terminals are held at the insulated housing. The grounding plate is at the insulated housing. The grounding plate comprises a plate body, a plurality of extension arms, a plurality of engaging rooms, and a plurality of contact regions. The front of the plate body is near to a front lateral surface of the tongue portion, and the rear of the plate body is extending to the base portion. The plate body is between the first receptacle terminals and the second receptacle terminals. The extension arms are extending from two sides of the plate body and each is bent as a hanging structure. Each of the hanging structures corresponds to an inner side, a top portion, and an outer side of the corresponding side wall. Each of the engaging rooms is formed in the corresponding extension arm to receive the corresponding side wall. Each of the contact regions is formed on an outer surface of the corresponding extension arm to be in contact with an inner wall of the shell body.

In one embodiment, the electrical receptacle connector further comprises a plurality of conductive sheets at the insulated housing. Each of the conductive sheets comprises a flat plate and a contact arm. The flat plates receptively cover two opposite surfaces of the tongue portion. Each of the contact arms is extending from a top of the flat plate and in contact with the inner wall of the shell body.

In one embodiment, the grounding plate comprises a plurality of protruding spots. The protruding spots are at the contact regions and in contact with the inner wall of the shell body.

In one embodiment, the metallic shell comprises a plurality of contact structures formed in the inner wall of the shell body to be in contact with the contact regions.

In one embodiment, the grounding plate comprises a plurality of through holes formed on the plate body.

In one embodiment, the insulated housing further comprises a third portion disposed between the first portion and the second portion, and the third portion forms the tongue portion. The first portion, the second portion, and the third portion are combined to form the base portion and the tongue portion, and the grounding plate is disposed at the third portion.

In one embodiment, the grounding plate comprises an engaging hole formed on the plate body. The second portion comprises an engaging block engaged in the engaging hole.

In one embodiment, the grounding plate comprises a shielding plate extending from an edge of the plate body, and the shielding plate is between the first receptacle terminals and the second receptacle terminals.

In one embodiment, the grounding plate comprises a plurality of hooks extending from two sides of the front of the plate body and protruding out of two sides of the tongue portion.

In one embodiment, the metallic shell comprises a cover plate covering one side of the shell body. The cover plate comprises a plurality of legs, and the legs are extending from the bottom of the cover plate.

In one embodiment, the metallic shell comprises a hollowed region, and the hollowed region is formed at one side of the shell body. When the cover plate is at an open position, the hollowed region is exposed; when the cover plate is at a close position, the cover plate is inserted into the shell body from the top to the bottom.

In one embodiment, the shell body comprises a tubular member, and the receptacle cavity is formed in the tubular member for receiving the insulated housing.

In one embodiment, the cover plate is extending from one side of the metallic shell and the cover plate covers an opening of the tubular member. The cover plate comprises an opening region recessed from a bottom thereof.

In one embodiment, the metallic shell comprises a plurality of buckle pieces respectively extending from two sides of the rear of the tubular member, and two sides of the cover plate are respectively buckled with the buckle pieces to cover the hollowed region.

In one embodiment, the shell body comprises an outer shell enclosing the tubular member.

In one embodiment, the metallic shell comprises a plurality of buckle pieces respectively extending from two sides of the rear of the outer shell, and two sides of the cover plate are respectively buckled with the buckle pieces to cover the hollowed region.

In one embodiment, the electrical receptacle connector further comprises a circuit board. The circuit board comprises a plurality of terminal contacts and a plurality of ground contacts, the terminal contacts correspond to the hollowed region and are soldered with the first receptacle terminals, and the legs of the cover plate are connected to the ground contacts, respectively.

In one embodiment, each of the ground contacts is a connecting hole, and each of the legs is inserted into the corresponding connecting hole to be in contact with an inner wall of the corresponding connecting hole.

In one embodiment, each of the terminal contacts is an elongated soldering pad, and the first receptacle terminals are in contact with the elongated soldering pads, respectively.

In one embodiment, the second portion comprises a plurality of assembling portions respectively recessed from the two side walls, and the extension arms are buckled with the assembling portions, respectively.

Another embodiment of the instant disclosure provides an electrical receptacle connector. The electrical receptacle connector comprises a metallic shell, an insulated housing, a plurality of first receptacle terminals, a plurality of second receptacle terminals, a grounding plate, and a plurality of conductive sheets. The metallic shell comprises a shell body and a receptacle cavity defined in the shell body. The insulated housing is received in the receptacle cavity of the metallic shell. The insulated housing comprises a base portion, a tongue portion, a plurality of recessed holes, and a plurality of buckle holes. The tongue portion is extending from one side of the base portion. The insulated housing comprises a first portion and a second portion. The first portion is disposed on a top surface of the second portion. The first portion and the second portion are combined to form the base portion and the tongue portion. The recessed holes are formed on two surfaces of the tongue portion. The buckle holes are formed on the two surfaces of the tongue portion and near to the recessed holes. The first receptacle terminals are held at the insulated housing. The second receptacle terminals are held at the insulated housing. The grounding plate is at the insulated housing. The grounding plate comprises a plate body between the first receptacle terminals and the second receptacle terminals. The conductive sheets are at the insulated housing. Each of the conductive sheets comprises a flat plate, a protruding portion, a buckle arm, and a contact arm. The flat plates cover the two surfaces of the tongue portion. Each of the protruding portions is extending laterally and outward from the corresponding flat plate and extending toward the corresponding recessed hole. The protruding portion at a first surface of the two surfaces of the tongue portion is in contact with the first receptacle terminals, and the protruding portion at a second surface of the two surfaces of the tongue portion is in contact with the second receptacle terminals. Each of the buckle arms is extending laterally and outward from the corresponding flat plate and extending into the corresponding buckle hole. Each of the buckle arms is in contact with the plate body of the grounding plate. Each of the contact arms is extending from a top of the corresponding flat plate and in contact with an inner wall of the shell body.

In one embodiment, the grounding plate comprises a plurality of through holes formed on the plate body.

In one embodiment, the insulated housing further comprises a third portion disposed between the first portion and the second portion, and the third portion forms the tongue portion. The first portion, the second portion, and the third portion are combined to form the base portion and the tongue portion, and the grounding plate is disposed at the third portion. The recessed holes are formed on the first portion and the second portion. The buckle holes are formed on the first portion, the second portion, and the third portion.

In one embodiment, the grounding plate comprises an engaging hole formed on the plate body. The second portion comprises an engaging block engaged in the engaging hole.

In one embodiment, the grounding plate comprises a shielding plate extending from an edge of the plate body, and the shielding plate is between the first receptacle terminals and the second receptacle terminals.

In one embodiment, the grounding plate comprises a plurality of hooks extending from two sides of the front of the plate body and protruding out of two sides of the tongue portion.

In one embodiment, the metallic shell comprises a cover plate covering one side of the shell body. The cover plate comprises a plurality of legs, and the legs are extending from the bottom of the cover plate.

In one embodiment, the metallic shell comprises a hollowed region, and the hollowed region is formed at one side of the shell body. When the cover plate is at an open position, the hollowed region is exposed; when the cover plate is at a close position, the cover plate is inserted into the shell body from the top to the bottom.

In one embodiment, the shell body comprises a tubular member, and the receptacle cavity is formed in the tubular member for receiving the insulated housing.

In one embodiment, the cover plate is extending from one side of the metallic shell and the cover plate covers an opening of the tubular member. The cover plate comprises an opening region recessed from a bottom thereof.

In one embodiment, the metallic shell comprises a plurality of buckle pieces respectively extending from two sides of the rear of the tubular member, and two sides of the cover plate are respectively buckled with the buckle pieces to cover the hollowed region.

In one embodiment, the shell body comprises an outer shell enclosing the tubular member.

In one embodiment, the metallic shell comprises a plurality of buckle pieces respectively extending from two sides of the rear of the outer shell, and two sides of the cover plate are respectively buckled with the buckle pieces to cover the hollowed region.

In one embodiment, the electrical receptacle connector further comprises a circuit board. The circuit board comprises a plurality of terminal contacts and a plurality of ground contacts, the terminal contacts correspond to the hollowed region and are soldered with the first receptacle terminals, and the legs of the cover plate are connected to the ground contacts, respectively.

In one embodiment, each of the ground contacts is a connecting hole, and each of the legs is inserted into the corresponding connecting hole to be in contact with an inner wall of the corresponding connecting hole.

In one embodiment, each of the terminal contacts is an elongated soldering pad, and the first receptacle terminals are in contact with the elongated soldering pads, respectively.

In the foregoing embodiments, the first receptacle terminals and the second receptacle terminals have 180 degree symmetrical design with respect to a central point of the receptacle cavity as the symmetrical center. In addition, the position of the first receptacle terminals corresponds to the position of the second receptacle terminals.

As above, the lengthened grounding plate improves the shielding performance and the structural strength of the tongue portion. In addition, the extension arms are in contact with the inner wall of the metallic shell to provide grounding and to reduce the electromagnetic interference (EMI). Moreover, because the contact arms of the conductive sheets are in contact with the inner wall of the metallic shell, the front of the metallic shell of an electrical plug connector is in contact with the conductive sheets when the electrical plug connector is mated with the electrical receptacle connector, so the metallic shell of the electrical plug connector is in contact with the metallic shell of the electrical receptacle connector. Accordingly, the connector can be effectively grounded through the conductive sheets and the electromagnetic interference is reduced.

In addition, the cover plate is at one side of the metallic shell, and the hollowed region corresponds to the cover plate. Accordingly, the soldering condition between the first receptacle terminals and the circuit board can be checked from the hollowed region.

Moreover, the protruding portions of the conductive sheets are in contact with the ground terminals of the first and second receptacle terminals, the buckle arms of the conductive sheets are in contact with the grounding plate, and the contact arms are in contact with the inner wall of the metallic shell. Therefore, the conductive sheets, the grounding plate, and the metallic shell can be conducted, grounded, and the electromagnetic interference can be reduced.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180 degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein:

FIG. 9 illustrates a schematic configuration diagram of the receptacle terminals of the electrical receptacle connector shown in FIG. 8;

DETAILED DESCRIPTION

Figure 1:
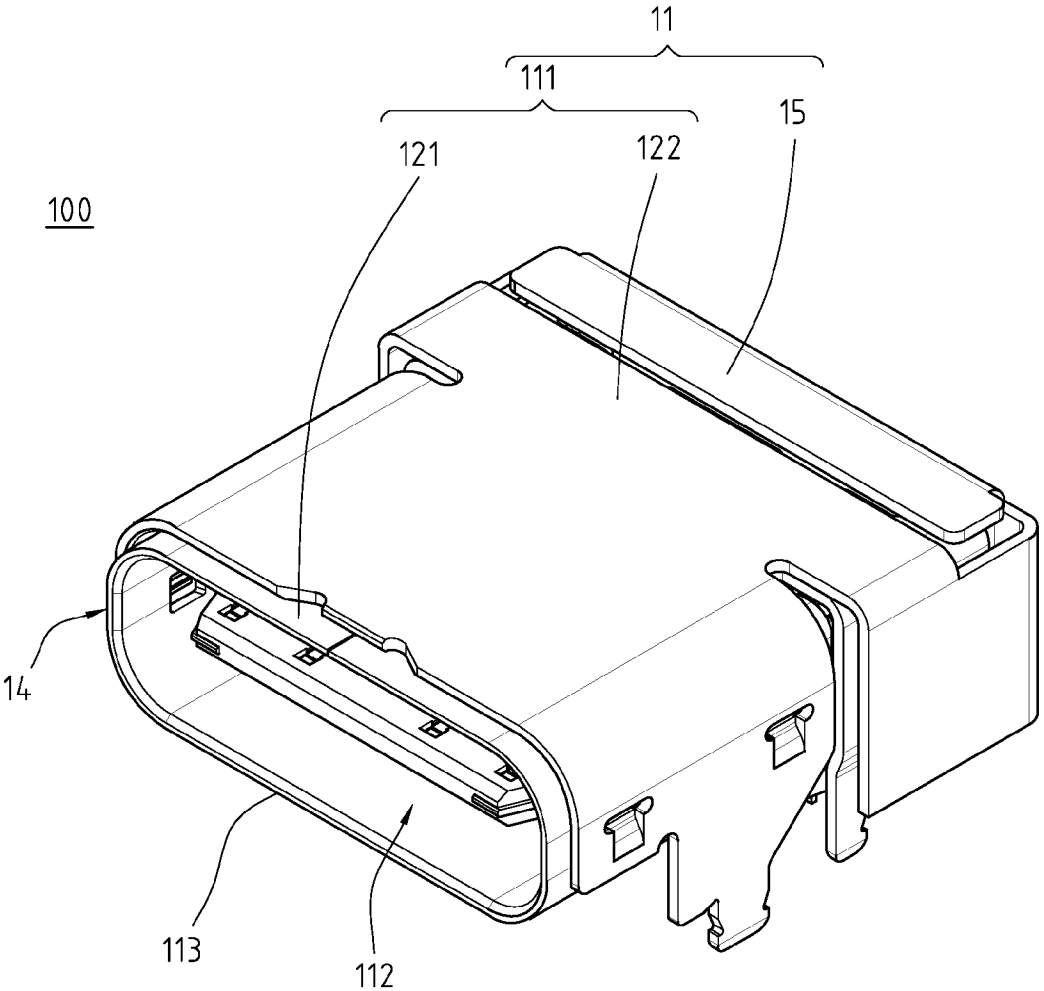
FIG. 1 illustrates a perspective view of an electrical receptacle connector according to a first embodiment of the instant disclosure.
Figure 2:
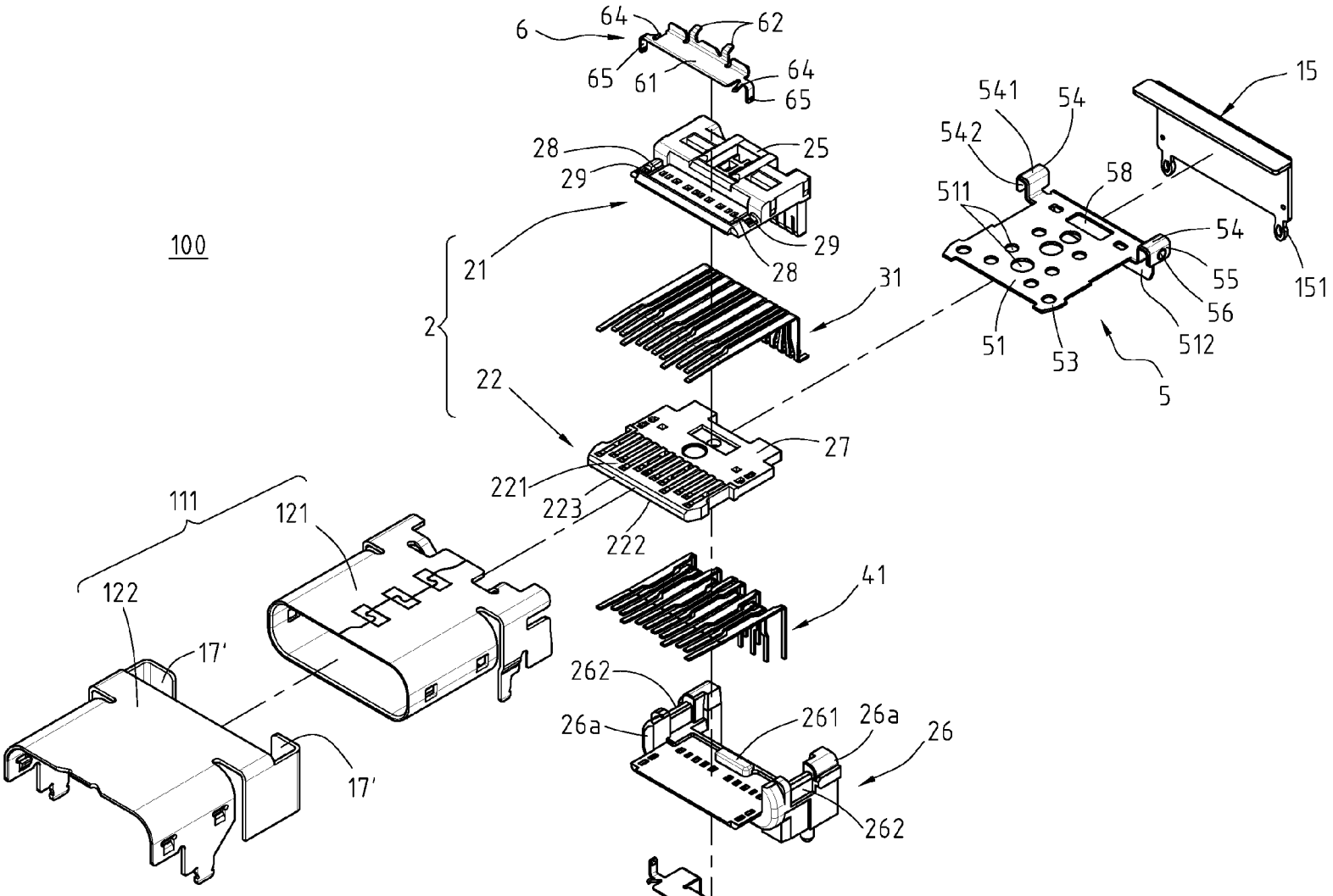
FIG. 2 illustrates an exploded view of the electrical receptacle connector of the first embodiment.
Figure 3:
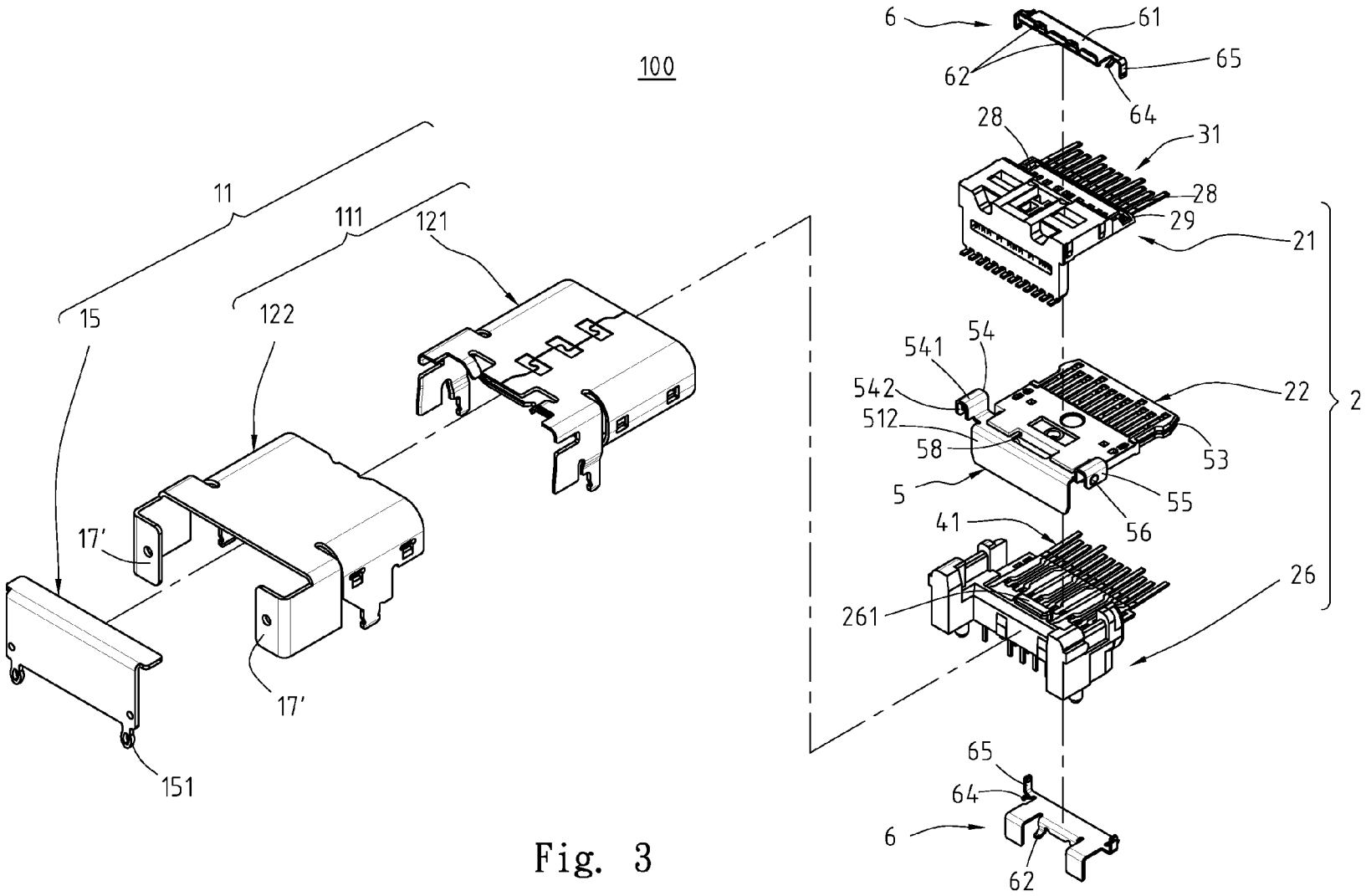
FIG. 3 illustrates another exploded view of the electrical receptacle connector of the first embodiment.
Figure 4:
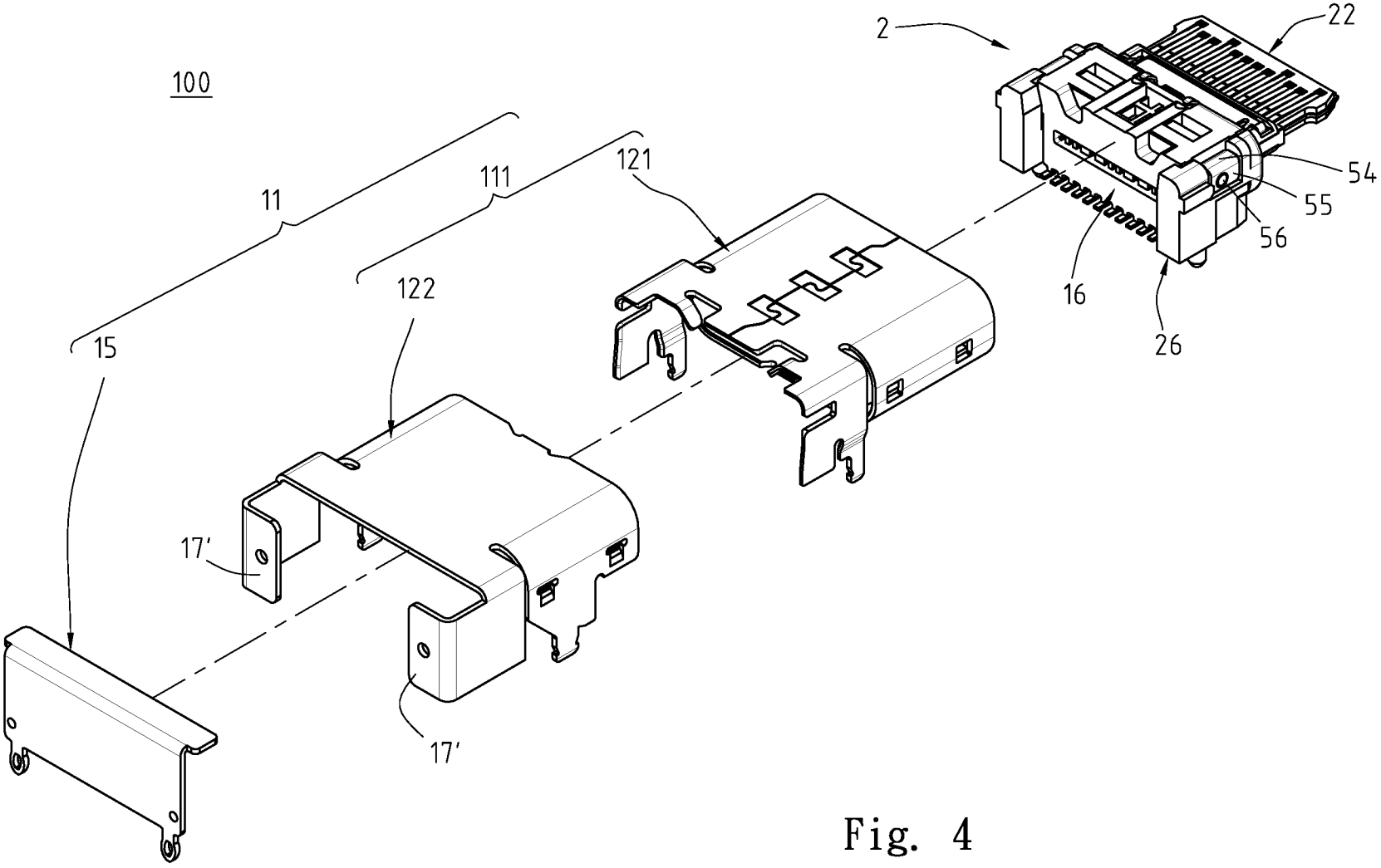
FIG. 4 illustrates a partial exploded view of the electrical receptacle connector of the first embodiment.

Please refer to FIGS. 1 to 4, which illustrate an electrical receptacle connector 100 of a first embodiment of the instant disclosure. FIG. 1 illustrates a perspective view of the electrical receptacle connector 100 of the first embodiment. FIG. 2 illustrates an exploded view of the electrical receptacle connector 100 of the first embodiment. FIG. 3 illustrates another exploded view of the electrical receptacle connector 100 of the first embodiment. FIG. 4 illustrates a partial exploded view of the electrical receptacle connector 100 of the first embodiment. In this embodiment, the electrical receptacle connector 100 can provide a reversible or dual orientation USB Type-C connector interface and pin assignments, i.e., a USB Type-C receptacle connector. In this embodiment, the electrical receptacle connector 100 comprises a metallic shell 11, an insulated housing 2, a plurality of first receptacle terminals 31, and a plurality of second receptacle terminals 41, a grounding plate 5, and a plurality of conductive sheets 6.

Please refer to FIGS. 2 to 4. The metallic shell 11 is a hollowed shell, and the metallic shell 11 comprises a shell body 111, a receptacle cavity 112, a cover plate 15, and a hollowed region 16. The receptacle cavity 112 is formed in the shell body 111. The cover plate 15 and the shell body 111 are separated pieces. The cover plate 15 is covered on one side of the shell body 111. The cover plate 15 comprises a plurality of legs 151, and the legs 151 are respectively extending outward from two sides of the bottom of the cover plate 15. In this embodiment, the metallic shell 11 may be formed by a multi-piece member; and the shell body 111 comprises a tubular member 14 and an outer shell 122. The tubular member 14 is an inner shell 121 that is hollowed and enclosed by the outer shell 122. The receptacle cavity 112 is in the tubular member 14, and the insulated housing 2 is received in the receptacle cavity 112. The outer shell 122 is a member having U-shape cross section. The outer shell 122 covers the top and two sides of the tubular member 14, and the cover plate 15 is assembled with the outer shell 122. In addition, an insertion opening 113 with oblong shaped is formed at one side of the metallic shell 11, and the insertion opening 113 communicates with the receptacle cavity 112.

Please refer to FIGS. 2 to 4. In this embodiment, the metallic shell 11 comprises a plurality of buckle pieces 17'. In this embodiment, the buckle pieces 17' and the shell body 111 are formed integrally as a whole. The buckle pieces 17' are respectively extending from two sides of the rear of the outer shell 122. As shown, a space is between the buckle piece 17' at the left side of the rear of the outer shell 122 and the buckle piece 17' at the right side of the rear of the outer shell 122, and the space is the hollowed region 16. In other words, the location of the hollowed region 16 corresponds to the position of the cover plate 15, and the hollowed region 16 can be provided for checking the tail portions 316 of the first receptacle terminals 31. In addition, when the cover plate 15 is at an open position, the hollowed region 16 is exposed; while when the cover plate 15 is at a close position, the cover plate 15 covers the rear of the outer shell 122 to cover the hollowed region 16. That is, when the cover plate 15 is assembled to the rear of the outer shell 122 along a top-to-bottom direction, two sides of the cover plate 15 are respectively buckled with the buckle pieces 17' to cover the hollowed region 16. In this embodiment, the cover plate 15 comprises a plurality of engaging bumps at two sides of the surface thereof. Each of the buckle pieces 17' comprises an engaging bore, the engaging bumps are held in the engaging bores, so that the cover plate 15 is positioned to the buckle pieces 17'.

Figure 5:
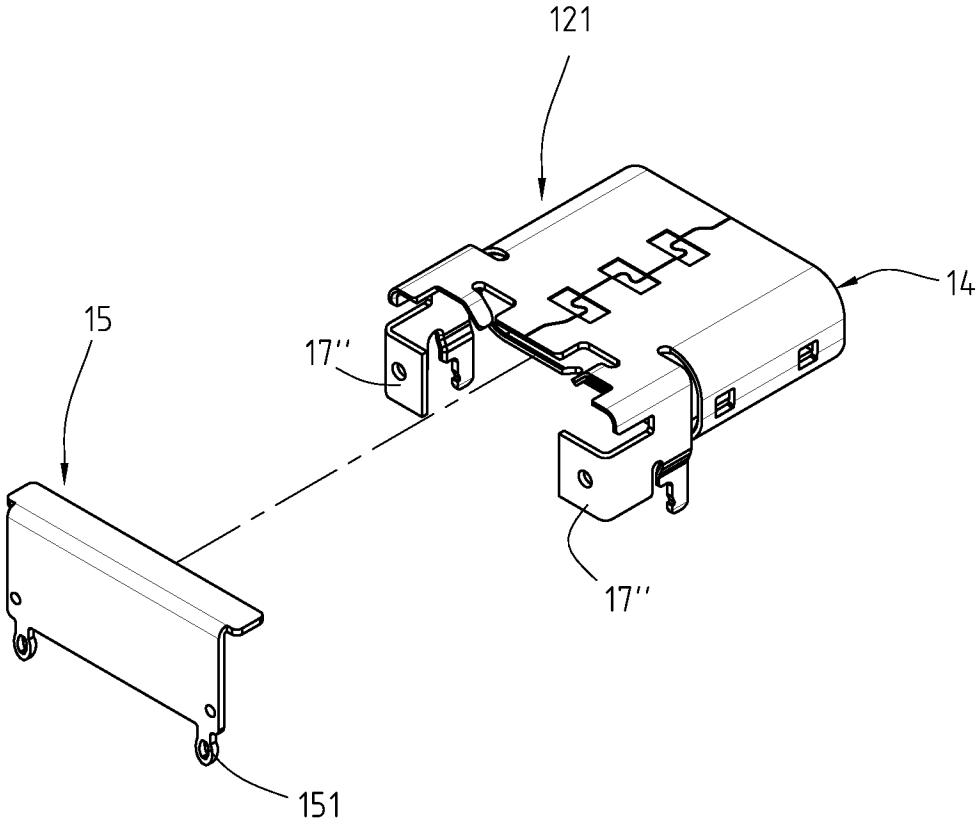
FIG. 5 illustrates an exploded view of an embodiment of an assembly of a tubular member and a cover plate of the electrical receptacle connector.

Please refer to FIG. 5. In this embodiment, as described, the cover plate 15 may be assembled with the outer shell 122, but embodiments are not limited thereto. In some embodiments, the cover plate 155 may be assembled with the tubular member 14, and the outer shell 122 is omitted. That is, the buckle pieces 17" and the tubular member 14 are integrally formed as a whole. The buckle pieces 17" are respectively extending from two sides of the rear of the tubular member 14, and the two sides of the cover plate 15 are buckled with the buckle pieces 17" to cover the hollowed region 16. In addition, in some embodiments, the cover plate 15 may be further assembled to the insulated housing 2. Namely, the insulated housing 2 comprises a plurality of buckle pieces 17' integrally formed with the base portion 21. The buckle pieces 17' are respectively extending from two sides of the rear of the base portion, 21 and the two sides of the cover plate 15 are buckled with the buckle pieces 17' to cover the hollowed region 16. In other words, the buckle pieces 17' may be provided by the metallic shell 11 or by the insulated housing 2 for diverse applications.

Figure 6:
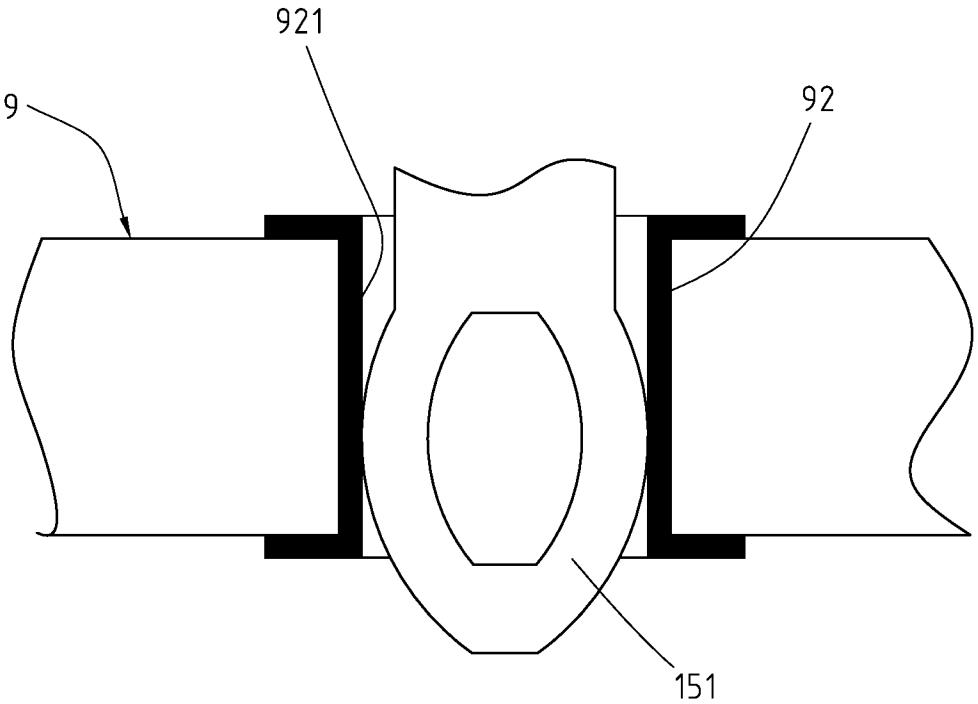
FIG. 6 illustrates an assembled schematic view of a circuit board and a leg of the cover plate of the electrical receptacle connector.

Please refer to FIGS. 3, 4, and 6. In this embodiment, the cover plate 15 and the shell body 111 may be separated pieces. The cover plate 15 covers an opening at one side of the tubular member 14 when the cover plate 15 is assembled to one side of the shell body 111. In other words, the cover plate 15 covers the hollowed region 16 at the opening to prevent the signal of the first receptacle terminals 31 or the second receptacle terminals 41 from spreading out of the tubular member 14, so as that the cover plate 15 can be provided as a shielding for the signals. Moreover, it is understood that, when the cover plate 15 is not assembled to one side of the shell body 111, the hollowed region 16 at the opening of the tubular member 14 is exposed, so that the soldering condition between the tail portions 316 of the first receptacle terminals 31 and the terminal contacts 91 of the circuit board 9 can be checked conveniently. Therefore, the soldering procedure can be redone when soldering spots are not applied to the terminal contacts 91 and the tail portions 316 properly, for example, if the tail portions 316 of the first receptacle terminals 31 and the terminal contacts 91 of the circuit board 9 are not firmly in contact with each other, or if the soldering spots between the tail portions 316 of the first receptacle terminals 31 are merged together to cause short circuit. After the checking procedure is finished, the cover plate 15 can be assembled to the opening of the tubular member 14 to cover the hollowed region 16.

Figure 6A:
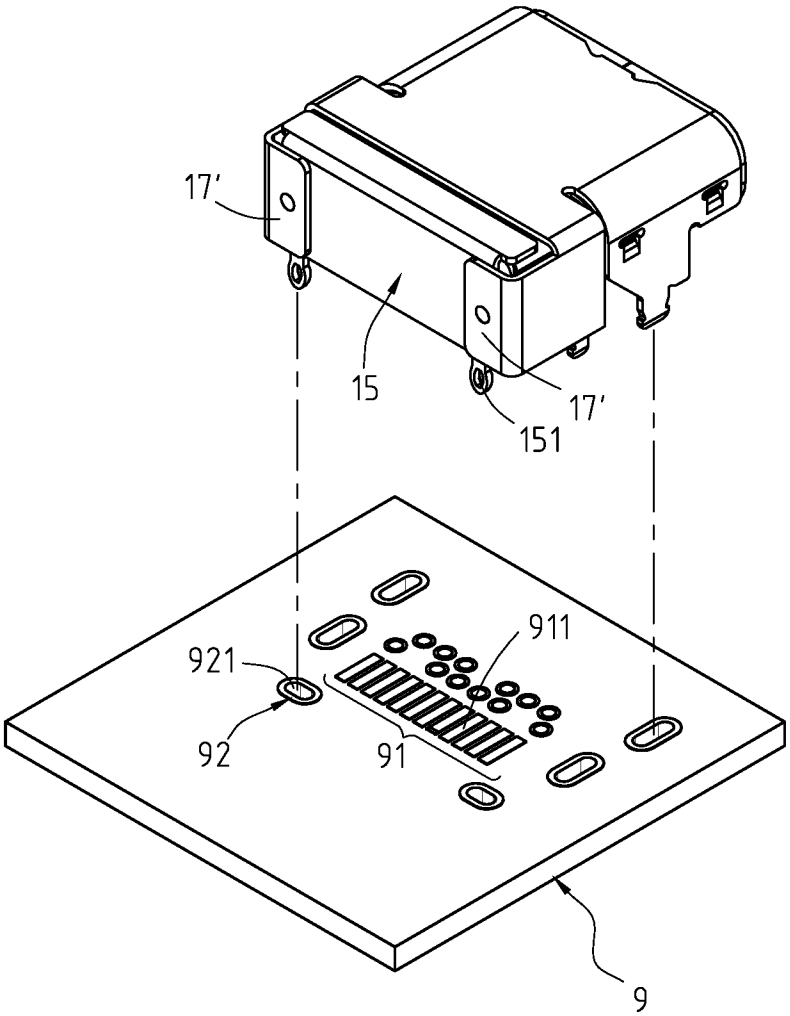
FIG. 6A illustrates an exploded view of the electrical receptacle connector and the circuit board of the first embodiment.

Please refer to FIGS. 3, 6, and 6A. In this embodiment, the appearance of each of the legs 151 of the cover plate 15 is formed as a fish-eye structure. In detail, the leg 151 is in tear shape, and the middle of the leg 151 is hollowed to form a hole. Accordingly, the legs 151 can be combined with the circuit board 9 by assembling means. In this embodiment, the circuit board 9 comprises a plurality of terminal contacts 91 and a plurality of ground contacts 92. The terminal contacts 91 correspond to the hollowed region 16 and the terminal contacts 91 are soldered with the tail portions 316 of the first receptacle terminals 31. The legs 151 of the cover plate 15 are connected to the ground contacts 92, respectively. Each of the ground contacts 92 is a connecting hole 921. Each of the legs 151 is inserted into the corresponding connecting hole 921 to be in contact with an inner wall of the corresponding connecting hole 921. In other words, the ground contacts 92 of the circuit board 9 are designed as holes for being inserted by the legs 151. There, the ground contacts 92 can be provided for grounding the metallic shell 11 and the circuit board 9. Based on the above, the circuit board 9 can be combined with the legs 151 without soldering procedures, and the movable cover plate 15 facilitates the assembling or disassembling of the circuit board 9 and the legs 151.

Please refer to FIGS. 2 to 4. In this embodiment, the insulated housing 2 is received in the receptacle cavity 112 of the metallic shell 11. The insulated housing 2 comprises a base portion 21 and a tongue portion 22. In this embodiment, the insulated housing 2 further comprises a first portion 25, a second portion 26, and a third portion 27. The first portion 25 is assembled to the top surface of the third portion 27, and the second portion 26 is assembled to the bottom surface of the third portion 27. The first portion 25, the second portion 26, and the third portion 27 are combined to form the base portion 21 and the tongue portion 22. Specifically, the third portion 27 is an elongate plate to form the tongue portion 22, the first portion 25 is a rectangular block to form the upper part of the base portion 21, and the second portion 26 is another rectangular block to form the lower part of the base portion 21. The third portion 27 is between the first portion 25 and the second portion 26. In the forgoing embodiment, the insulated housing 2 has three pieces, i.e., the first portion 25, the second portion 26, and the third portion 27, but embodiments are not limited thereto. In some embodiments, the insulated housing 2 may at least comprise two pieces, i.e., the first portion 25 and the second portion 26. The first portion 25 and the second portion 26 are combined to form the base portion 21 and the tongue portion 22. In this embodiment, the first portion 25 is disposed on a top surface of the second portion 26. In addition, the first portion 25 may be formed as the upper part of the base portion 21, and the second portion 26 may be formed as the lower part of the base portion 21. Furthermore, the tongue portion 22 may be formed at the front of the first portion 25 or the front of the second portion 26. In this embodiment, the second portion 26 comprises two side walls 26*a*, the two side walls 26*a* are respectively extending upward from two sides of the second portion 26 along the same direction. An assembling space is between the two side walls 26*a* for assembling the first portion 25.

Please refer to FIGS. 2 to 4. In this embodiment, the first portion 25, the second portion 26, and the third portion 27 may be respectively formed by insert-molded techniques. In detail, the first portion 25 is insert-molded with the first receptacle terminals 31, the second portion is insert-molded with the second receptacle terminals 41, and the third portion 27 is insert-molded with the grounding plate 5. In other words, the grounding plate 5 is in the base portion 21 and the tongue portion 22. Accordingly, by using the insert-molding techniques, the mold for molding the components of the insulated housing 2 (i.e., the first portion 25, the second portion 26, and the third portion 27) as well as the insulated housing 2 can be manufactured easily and steadily. In addition, the tongue portion 22 is extending from one side of the base portion 21, and the tongue portion 22 is in the front of the receptacle cavity 112, while the base portion 21 is in the rear of the receptacle cavity 112. In addition, the tongue portion 22 has two opposite surfaces, one is a first surface 221 (i.e., the upper surface), and the other is a second surface 222 (i.e., the lower surface). In addition, the front lateral surface 223 of the tongue portion 22 is connected the first surface 221 with the second surface 222 and is close to the insertion opening 113. In other words, the front lateral surface 223 is near to the insertion opening 113 and perpendicularly connected to the first surface 221 and the second surface 222, respectively. In this embodiment, the insulated housing 2 has three pieces, but embodiments are not limited thereto; the insulated housing may have two pieces in some embodiments.

Please refer to FIGS. 7 to 10. The first receptacle terminals 31 comprise a plurality of first signal terminals 311, at least one power terminal 312, and at least one ground terminal 313. The first signal terminals 31 comprises a plurality of pairs of first high-speed signal terminals 3111/3113 and a pair of first low-speed signal terminals 3112. Referring to FIG. 9, the first receptacle terminals 31 comprise, from left to right, a ground terminal 313 (Gnd), a first pair of first high-speed signal terminals 3111 (TX1+−, differential signal terminals for high-speed signal transmission), a power terminal 312 (Power/VBUS), a first function detection terminal 3141 (CC1, a terminal for inserting orientation detection of the connector and for cable recognition), a pair of first low-speed signal terminals 3112 (D+−, differential signal terminals for low-speed signal transmission), a supplement terminal 3142 (SBU1, a terminal can be reserved for other purposes), another power terminal 312 (Power/VBUS), a second pair of first high-speed signal terminals 3113 (RX2+−, differential signal terminals for high-speed signal transmission), and another ground terminal 313 (Gnd). In this embodiment, twelve first receptacle terminals 31 are provided for transmitting USB 3.0 signals. Each pair of the first high-speed signal terminals 3111/3113 is between the corresponding power terminal 312 and the adjacent ground terminal 313. The pair of the first low-speed signal terminals 3112 is between the first function detection terminal 3141 and the supplement terminal 3142.

In some embodiments, the rightmost ground terminal 313 (Gnd) (or the leftmost ground terminal 313 (Gnd)) or the first supplement terminal 3142 (SBU1) can be further omitted. Therefore, the total number of the first receptacle terminals 31 can be reduced from twelve terminals to seven terminals. Furthermore, the ground terminal 313 (Gnd) may be replaced by a power terminal 312 (Power/VBUS) and provided for power transmission. In this embodiment, the width of the power terminal 312 (Power/VBUS) may be, but not limited to, equal to the width of the first signal terminal 311. In some embodiments, the width of the power terminal 312 (Power/VBUS) may be greater than the width of the first signal terminal 311 and an electrical receptacle connector 100 having the power terminal 312 (Power/VBUS) can be provided for large current transmission.

Figure 7:
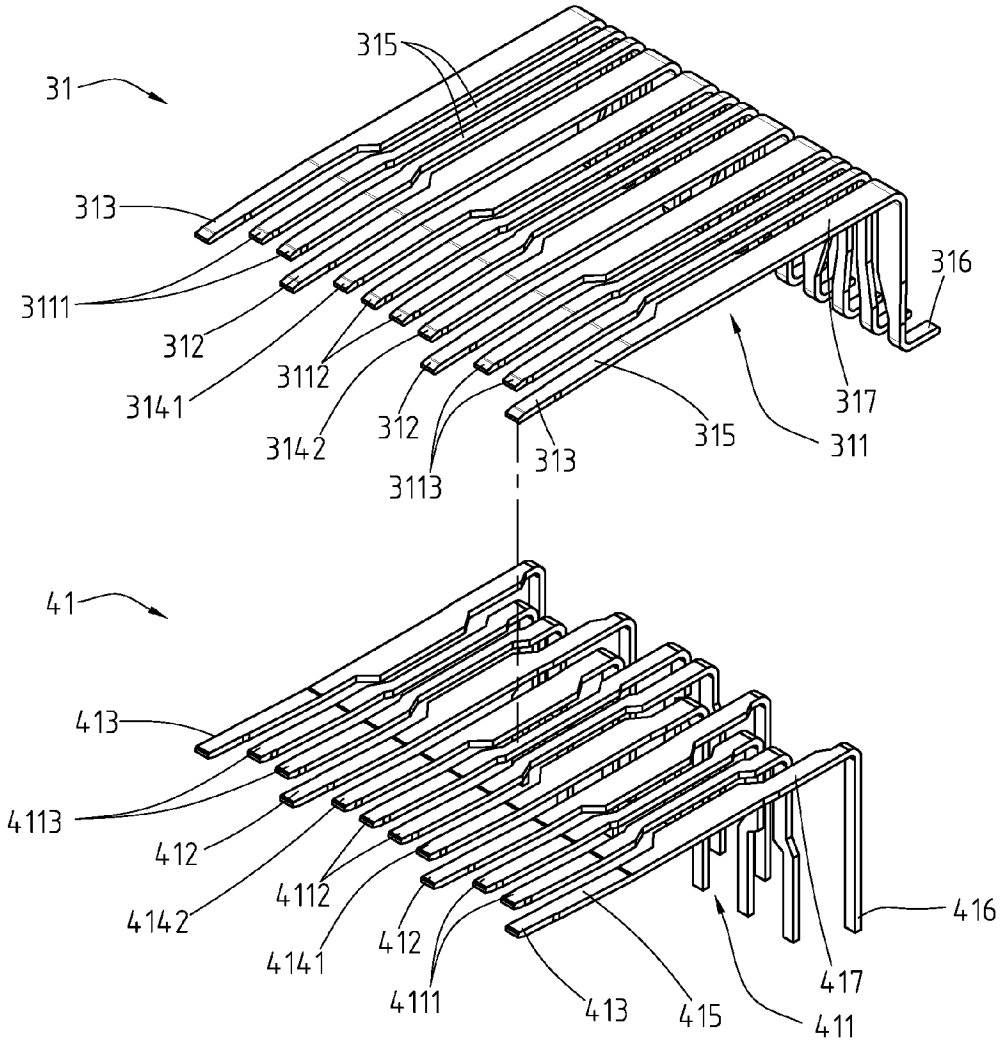
FIG. 7 illustrates a perspective view of receptacle terminals of the electrical receptacle connector of the first embodiment.
Figure 10:
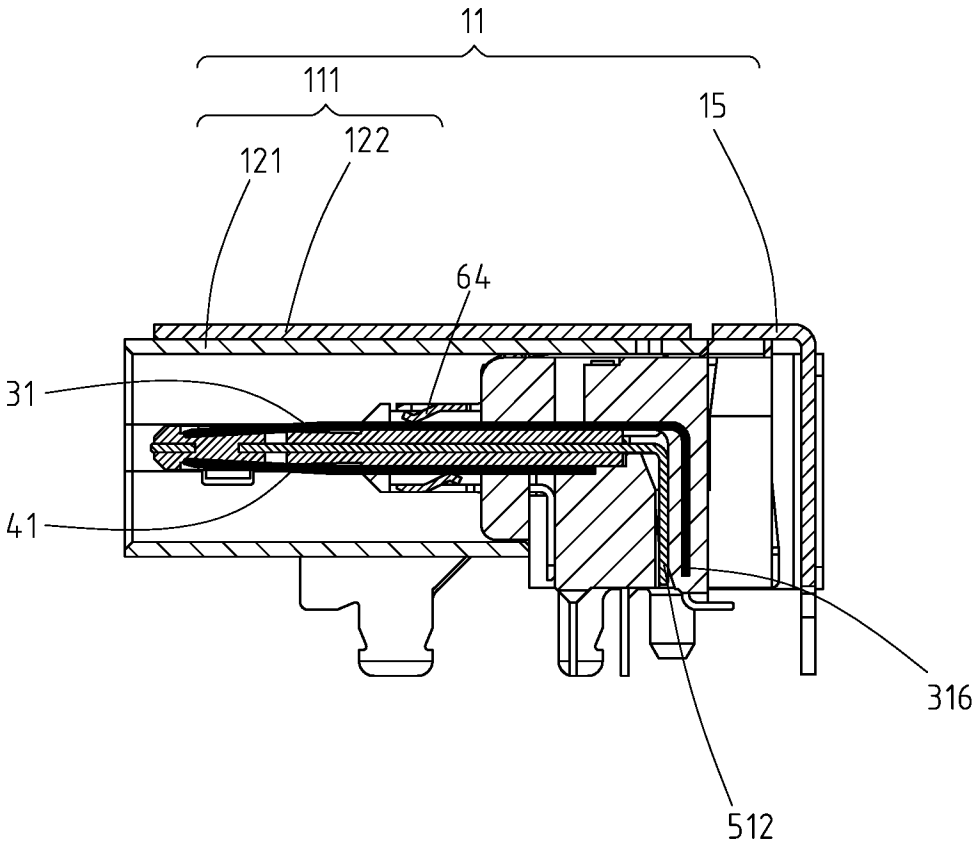
FIG. 10 illustrates a lateral sectional view of the electrical receptacle connector of the first embodiment.

Please refer to FIGS. 2, 7, and 10. The first receptacle terminals 31 are held in the base portion 21 and the tongue portion 22 and formed as the upper-row terminals of the electrical receptacle connector 100. Each of the first receptacle terminals 31 comprises a flat contact portion 315, a body portion 317, and a tail portion 316. For each of the first receptacle terminals 31, the body portion 317 is held in the base portion 21 and the tongue portion 22, the flat contact portion 315 is extending forward from the body portion 317 in the rear-to-front direction and partly exposed upon the first surface 221 of the tongue portion 22, and the tail portion 316 is extending backward from the body portion 317 in the front-to-rear direction and protruding from the base portion 21. The tail portions 316 correspond to the hollowed region 16. The first signal terminals 311 are disposed at the first surface 221 and transmit first signals (namely, USB 3.0 signals). The tail portions 316 are protruding from the bottom of the base portion 21. In addition, the tail portions 316 may be, but not limited to, bent horizontally to form flat legs, named SMT (surface mounted technology) legs, which can be mounted or soldered on the surface of a printed circuit board by using surface mount technology.

Figure 15:
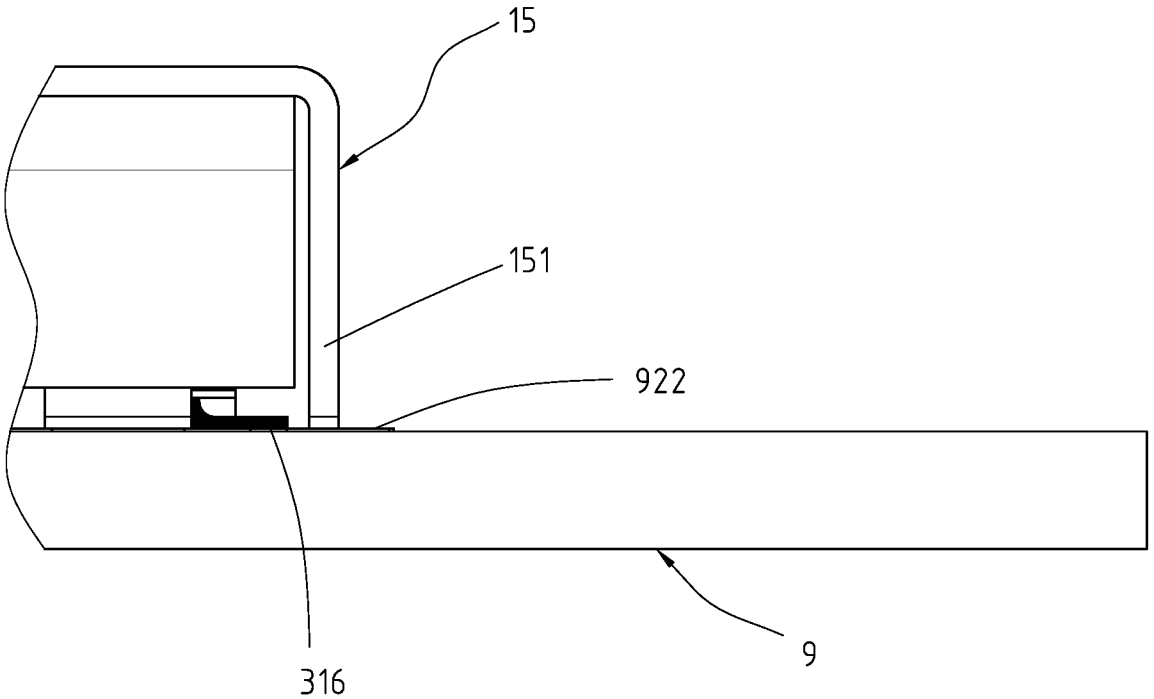
FIG. 15 illustrates a partial enlarged lateral view of the assembly of the circuit board and the electrical receptacle connector of the second embodiment.

Please refer to FIGS. 7 to 10. The second receptacle terminals 41 comprise a plurality of second signal terminals 411, at least one power terminal 412, and at least one ground terminal 413. The second receptacle terminals 41 comprise a plurality of pairs of second high-speed signal terminals 4111/4113 and a pair of second low-speed signal terminals 4112. Referring to FIG. 15, the second receptacle terminals 41 comprise, from right to left, a ground terminal 413 (Gnd), a first pair of second high-speed signal terminals 4111 (TX2+−,differential signal terminals for high-speed signal transmission), a power terminal 412 (Power/VBUS), a second function detection terminal 4141 (CC2, a terminal for inserting orientation detection of the connector and for cable recognition), a pair of second low-speed signal terminals 4112 (D+−, differential signal terminals for low-speed signal transmission), a supplement terminal 4142 (SBU2, a terminal can be reserved for other purposes), another power terminals 412 (Power/VBUS), a second pair of second high-speed signal terminals 4113 (RX1+−, differential signal terminals for high-speed signal transmission), and another ground terminal 413 (Gnd). Each pair of the second high-speed signal terminals 4111/4113 is between the corresponding power terminal 412 and the adjacent ground terminal 413. The pair of the second low-speed signal terminals 4112 is between the second function detection terminal 4141 and the supplement terminal 4142.

In some embodiments, the rightmost ground terminal 413 (or the leftmost ground terminal 413) or the second supplement terminal 4142 (SBU2) can be further omitted. Therefore, the total number of the second receptacle terminals 41 can be reduced from twelve terminals to seven terminals. Furthermore, the rightmost ground terminal 413 may be replaced by a power terminal 412 and provided for power transmission. In this embodiment, the width of the power terminal 412 (Power/VBUS) may be, but not limited to, equal to the width of the second signal terminal 411. In some embodiments, the width of the power terminal 412 (Power/VBUS) may be greater than the width of the second signal terminal 411 and an electrical receptacle connector 100 having the power terminal 412 (Power/VBUS) can be provided for large current transmission.

Please refer to FIGS. 2, 7, and 10. The second receptacle terminals 41 are held in the base portion 21 and the tongue portion 22 and formed as the lower-row terminals of the electrical receptacle connector 100. The length of each of the first receptacle terminals 31 is greater than that of the corresponding second receptacle terminal 41; that is, the exposed length of each of the first receptacle terminals 31 is greater than that of the corresponding second receptacle terminal 41. Each of the second receptacle terminals 41 comprises a flat contact portion 415, a body portion 417, and a tail portion 416. For each of the second receptacle terminals 41, the body portion 417 is held in the base portion 21 and the tongue portion 22, the flat contact portion 415 is extending from the body portion 417 in the rear-to-front direction and partly exposed upon the second surface 222 of the tongue portion 22, and the tail portion 416 is extending backward from the body portion 417 in the front-to-rear direction and protruding from the base portion 21. The second signal terminals 411 are disposed at the second surface 222 and provided for transmitting second signals (i.e., USB 3.0 signals). The tail portions 416 are protruding from the bottom of the base portion 21. In addition, the tail portions 416 may be, but not limited to, extending downwardly to form vertical legs, named through-hole legs, that are inserted into holes drilled in a printed circuit board by using through-hole technology Please refer to FIGS. 1, 7, and 8. In this embodiment, the first receptacle terminals 31 and the second receptacle terminals 41 are held at the first surface 221 and the second surface 222 of the tongue portion 22, respectively. Specifically, the second low-speed signal terminals 4112 are spaced from the first low-speed signal terminals 3112 by a uniform interval. Therefore, the signal interference problem between the first low-speed signal terminals 3112 and the second low-speed signal terminals 4112 can be prevented and improved.

Figure 8:
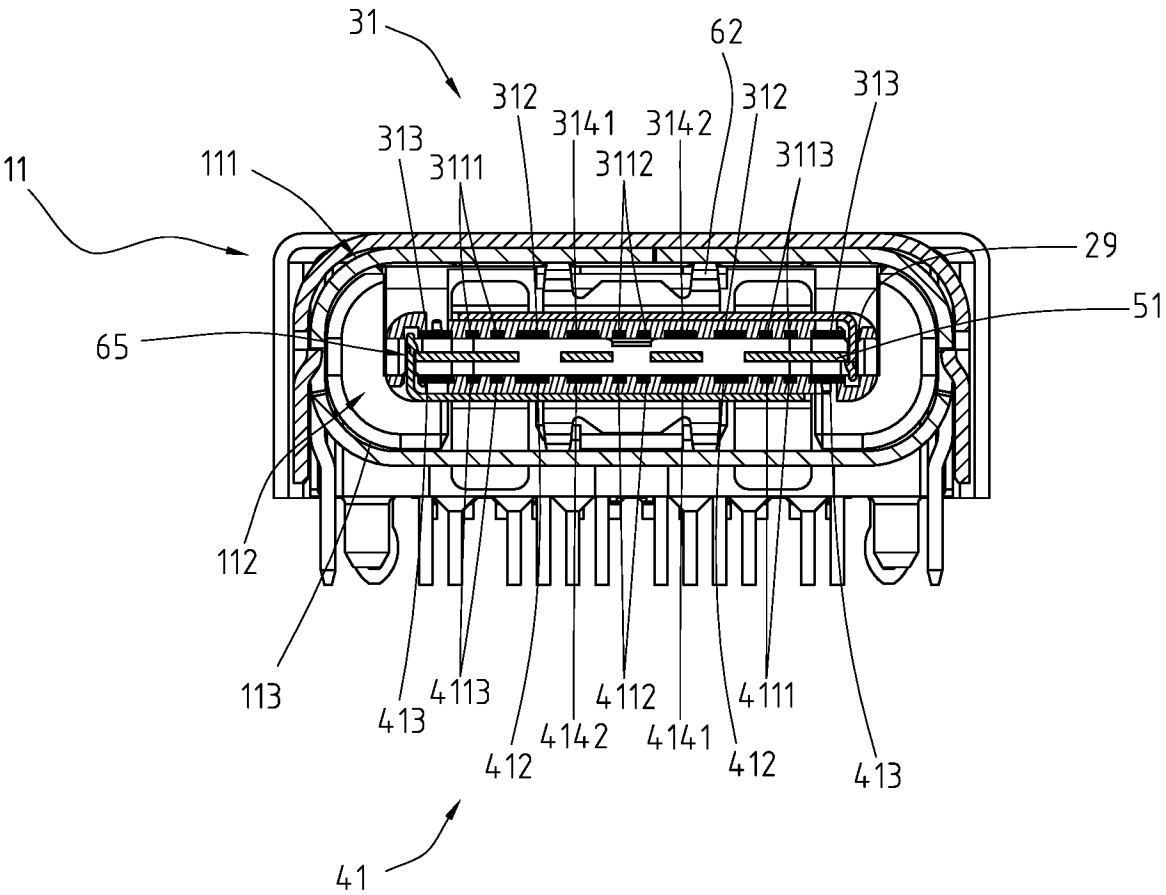
FIG. 8 illustrates a front sectional view of the electrical receptacle connector of the first embodiment.

Please refer to FIGS. 1, 7, and 8. Pin-assignments of the first receptacle terminals 31 and the second receptacle terminals 41 are point-symmetrical with a central point of the receptacle cavity 112 as the symmetrical center. In other words, pin-assignments of the first receptacle terminals 31 and the second receptacle terminals 41 have 180 degree symmetrical design with respect to the central point of the receptacle cavity 112 as the symmetrical center. The dual or double orientation design enables an electrical plug connector to be inserted into the electrical receptacle connector 100 in either of two intuitive orientations, i.e., in either upside-up or upside-down directions. Here, point-symmetry means that after the first receptacle terminals 31 (or the second receptacle terminals 41), are rotated by 180 degrees with the symmetrical center as the rotating center, the first receptacle terminals 31 and the second receptacle terminals 41 are overlapped. That is, the rotated first receptacle terminals 31 are arranged at the position of the original second receptacle terminals 41, and the rotated second receptacle terminals 41 are arranged at the position of the original first receptacle terminals 31. In other words, the first receptacle terminals 31 and the second receptacle terminals 41 are arranged upside down, and the pin assignments of the flat contact portions 315 are left-right reversal with respect to that of the flat contact portions 415. An electrical plug connector is inserted into the electrical receptacle connector 100 with a first orientation where the first surface 221 is facing up, for transmitting first signals. Conversely, the electrical plug connector is inserted into the electrical receptacle connector 100 with a second orientation where the first surface 221 is facing down, for transmitting second signals. Furthermore, the specification for transmitting the first signals is conformed to the specification for transmitting the second signals. Note that, the inserting orientation of the electrical plug connector is not limited by the electrical receptacle connector 100 according embodiments of the instant disclosure.

Additionally, in some embodiments, the electrical receptacle connector 100 is devoid of the first receptacle terminals 31 (or the second receptacle terminals 41) when an electrical plug connector to be mated with the electrical receptacle connector 100 has upper and lower plug terminals. In the case that the first receptacle terminals 31 are omitted, the upper plug terminals or the lower plug terminals of the electrical plug connector are in contact with the second receptacle terminals 41 of the electrical receptacle connector 100 when the electrical plug connector is inserted into the electrical receptacle connector 100 with the dual orientations. Conversely, in the case that the second receptacle terminals 41 are omitted, the upper plug terminals or the lower plug terminals of the electrical plug connector are in contact with the first receptacle terminals 31 of the electrical receptacle connector 100 when the electrical plug connector is inserted into the electrical receptacle connector 100 with the dual orientations.

Please refer to FIGS. 2, 7 to 10. In this embodiment, the tail portions 316, 416 are protruding from the base portion 211 and arranged separately. The tail portions 316, 416 may be aligned into two parallel rows. Alternatively, the tail portions 416 of the second receptacle terminals 41 may be aligned into two rows, and the first row of the tail portions 416 is aligned by an offset with respect to the second row (or the first row) of the tail portions 416; thus, the tail portions 316, 416 form three rows.

Please refer to FIGS. 2, 7, and 8. In this embodiment, as viewed from the front of the receptacle terminals 31, 41, the position of the first receptacle terminals 31 corresponds to the position of the second receptacle terminals 41. In other words, the position of the flat contact portions 315 correspond to the position of the flat contact portions 415, but embodiments are not limited thereto. In some embodiments, the first receptacle terminals 31 may be aligned by an offset with respect to the second receptacle terminals 41. That is, the flat contact portions 315 are aligned by an offset with respect to the flat contact portions 415. Accordingly, because of the offset alignment of the receptacle terminals 31, 41, the crosstalk between the first receptacle terminals 31 and the second receptacle terminals 41 can be reduced during signal transmission. It is understood that, when the receptacle terminals 31, 41 of the electrical receptacle connector 100 have the offset alignment, plug terminals of an electrical plug connector to be mated with the electrical receptacle connector 100 would also have the offset alignment. Hence, the plug terminals of the electrical plug connector can be in contact with the receptacle terminals 31, 41 of the electrical receptacle connector 100 for power or signal transmission.

In the foregoing embodiments, the receptacle terminals 31, 41 are provided for transmitting USB 3.0 signals, but embodiments are not limited thereto. In some embodiments, for the first receptacle terminals 31 in accordance with transmission of USB 2.0 signals, the first pair of the first high-speed signal terminals 3111 (TX1+−) and the second pair of the first high-speed signal terminals 3113 (RX2+−) are omitted, and the pair of the first low-speed signal terminals 3112 (D+−) and the power terminals 312 (Power/VBUS) are retained. While for the second receptacle terminals 41 in accordance with transmission of USB 2.0 signals, the first pair of the second high-speed signal terminals 4111 (TX2+−) and the second pair of the second high-speed signal terminals 4113 (RX1+−) are omitted, and the pair of the second low-speed signal terminals 4112 (D+−) and the power terminals 412 (Power/VBUS) are retained.

Please refer to FIGS. 2, 3, 8, and 10. In some embodiments, the grounding plate 5 is at the insulated housing 2. The grounding plate 5 comprises a plate body 51, a plurality of hooks 53, a plurality of extension arms 54, a plurality of engaging rooms 542, and a plurality of contact regions 55. The plate body 51 is an elongate plate, and the length and the width of the plate body 51 are matched with those of the third portion 27. In other words, the front of the plate body 51 is near to the front lateral surface 223 of the tongue portion 22, and the rear of the plate body 51 is extending to the base portion 21. In addition, the plate body 51 is between the flat contact portions 315 of the first receptacle terminals 31 and the flat contact portions 415 of the second receptacle terminals 41. The lengthened plate body 51 improves the shielding performance and the structural strength of the tongue portion 22. In detail, the crosstalk interference can be reduced by the shielding of the grounding plate 5 when the flat contact portions 315, 415 transmit signals. Furthermore, the structural strength of the tongue portion 22 can be improved by the assembly of the grounding plate 5.

As shown in FIGS. 2 and 3, the hooks 53 are extending outward from two sides of the front of the plate body 51 and protruding out of the front lateral surface 223 and two sides of the tongue portion 22. When an electrical plug connector is mated with the electrical receptacle connector 100, elastic pieces at two sides of an insulated housing of the electrical plug connector are engaged with the hooks 53, and the elastic pieces would not wear against the tongue portion 22 of the electrical receptacle connector 100. Hence, the grounding plate 5 can be in contact with the metallic shell 11 for conduction and grounding.

Figure 11C:
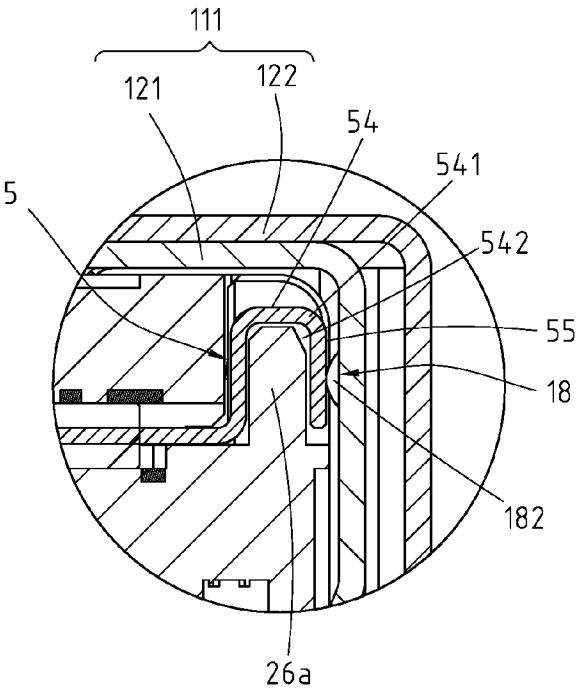
FIG. 11C illustrates a partial enlarged view (3) showing the contact between the grounding plate and the metallic shell of the electrical receptacle connector of the first embodiment.
Figure 11B:
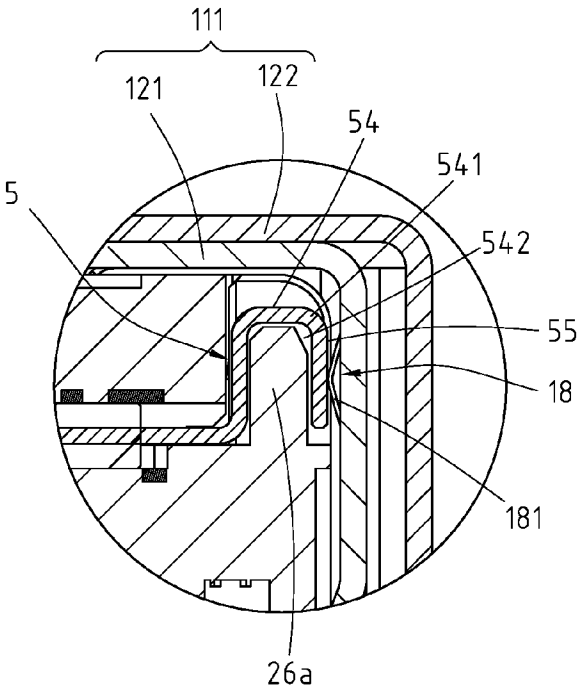
FIG. 11B illustrates a partial enlarged view (2) showing the contact between the grounding plate and the metallic shell of the electrical receptacle connector of the first embodiment.
Figure 11A:
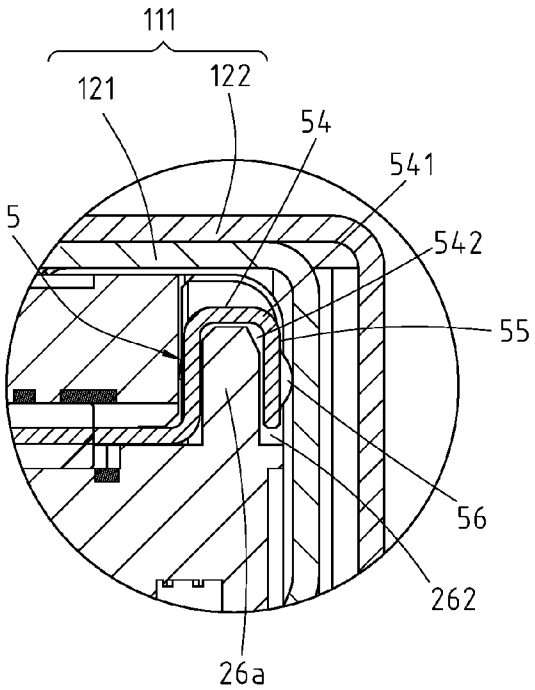
FIG. 11A illustrates a partial enlarged view (1) showing the contact between a grounding plate and a metallic shell of the electrical receptacle connector of the first embodiment.
Figure 12:
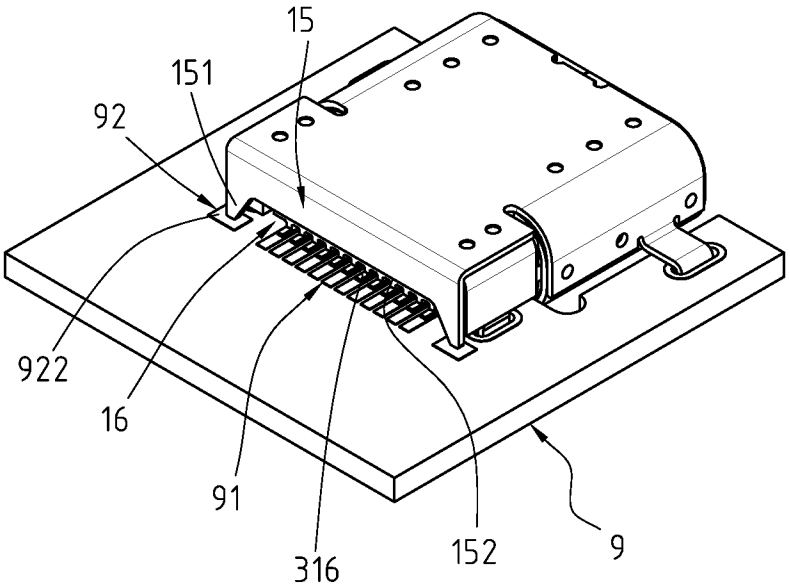
FIG. 12 illustrates a perspective view of an assembly of a circuit board and an electrical receptacle connector according to a second embodiment of the instant disclosure.
Figure 13:
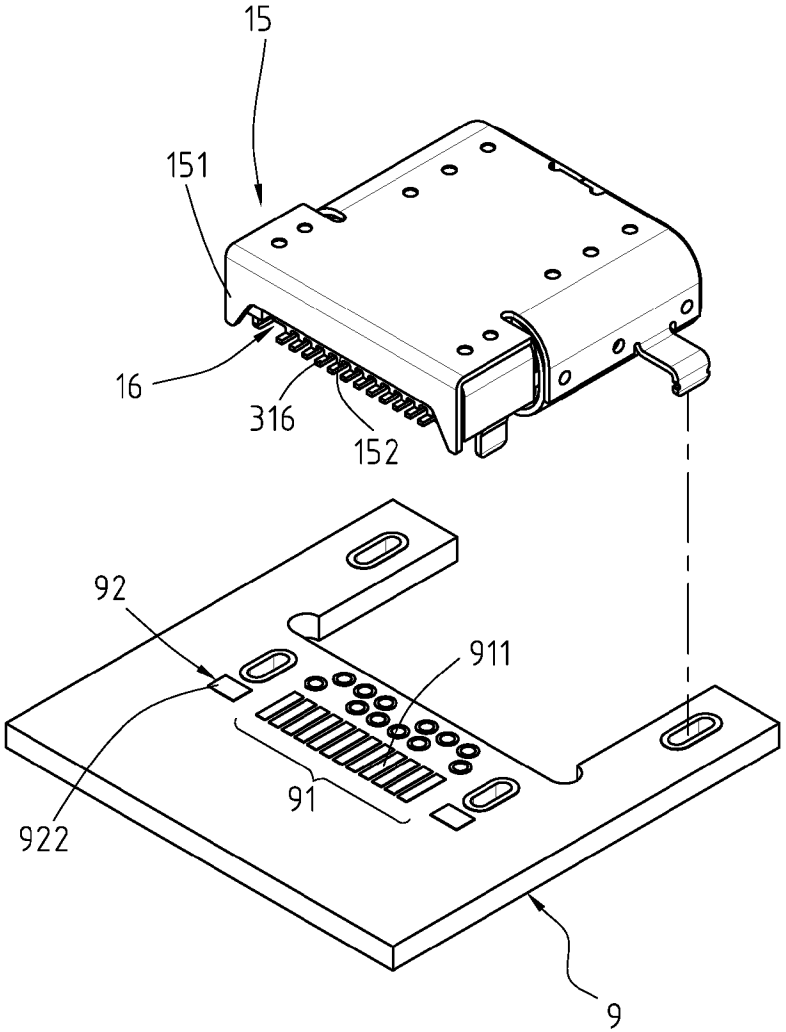
FIG. 13 illustrates an exploded view of the assembly of the circuit board and the electrical receptacle connector of the second embodiment.
Figure 14:
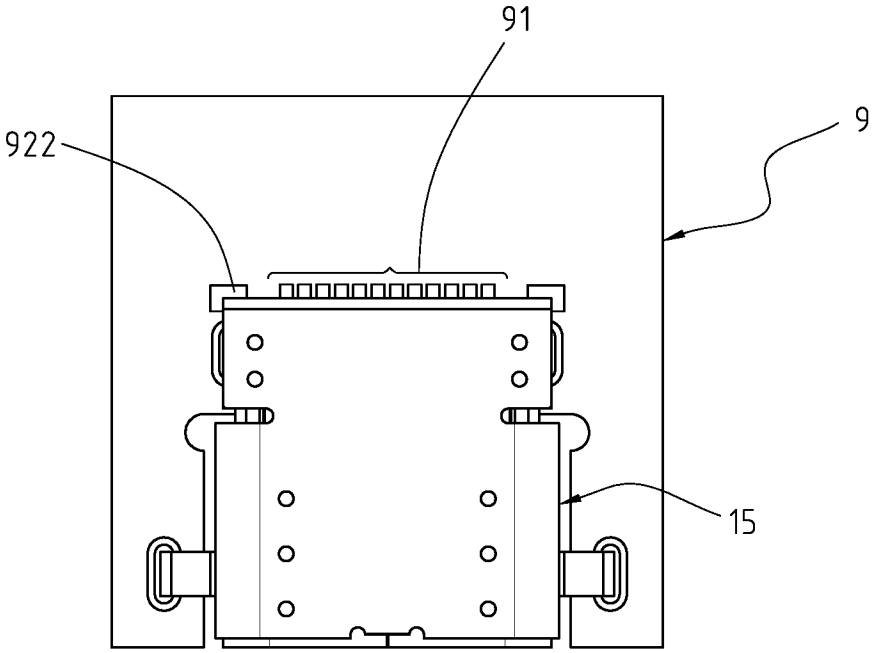
FIG. 14 illustrates a top view of the assembly of the circuit board and the electrical receptacle connector of the second embodiment.

Please refer to FIGS. 2, 3, and 11A. Each of the extension arms 54 is a hanging structure 541. Each of the extension arms 54 has an upside down U-shape cross section. The extension arms 54 are respectively extending outward from two sides of the rear of the plate body 51. In other words, each of the extension arms 54 is firstly extending upward by a first distance, then extending laterally by a second distance, and finally extending downward by a third distance; the first distance, the second distance, the third distance may be the same or different. The extension arms 54 are respectively protruding toward two sides of the base portion 21. The hanging structure 541 is a hook-like structure. In other words, the extension arms 54 are respectively extending from the plate body 51 by a manner of firstly extending toward two sides of the third portion 27 and then returning toward two sides of the second portions 26. Therefore, each of the hanging structures 541 corresponds to an inner side, a top portion, and an outer side of the corresponding side wall 26*a*. Each of the engaging rooms 542 is formed in the corresponding extension arm 54 to receive the corresponding side wall 26*a*. Because the hanging structures 541 are buckled with the side walls 26*a*, the grounding plate 5 can be firmly fixed on the insulated housing 2. In addition, in this embodiment, the second portion 26 comprises a plurality of assembling portions 262. Each of the assembling portions 262 is formed as a recess structure. Each of the assembling portions 262 is recessed from the inner side, the top portion, and the outer side of the corresponding side wall 26*a*. The extension arms 54 are buckled with the assembling portions 262, so that the second portion 26 can be firmly combined with the third portion 27.

Please refer to FIGS. 2, 3, and 11A. Each of the contact regions 55 is formed on an outer surface of the corresponding extension arm 54. Each of the contact regions 55 is in contact with an inner wall of the shell body 111. In this embodiment, the grounding plate 5 comprises a plurality of protruding spots 56 at the contact regions 55. The protruding spots 56 are in contact with the inner wall of the shell body 111. In other words, the protruding spots 56 are formed at the surfaces of the extension arms 54, so that the grounding plate 5 can be firmly in contact with the metallic shell 11 to improve the grounding and to reduce the electromagnetic interference (EMI).

Please refer to FIGS. 11B and 11C. In some embodiments, the grounding plate 5 may not comprise the protruding spots 56. Instead, the metallic shell 11 comprises a plurality of contact structures 18 formed in the inner wall of the shell body 111, and the contact structures 18 are in contact with the contact regions 55. In this embodiment, each of the contact structures 18 is a flexible piece 181 or a protrusion 182. The flexible piece 181 is extending from the inner wall of the shell body 111 toward the interior of the shell body 111 (i.e., toward the grounding plate 5). Likewise, the protrusion 182 is protruding from the inner wall of the shell body 111 toward the interior of the shell body 111 (i.e., toward the grounding plate 5). Accordingly, the flexible piece 181 or the protrusion 182 of the shell body 111 can be in contact with the contact regions 55, so the grounding plate 5 can be firmly in contact with the metallic shell 11 to improve the grounding and reduce the electromagnetic interference (EMI). Based on the above, the extension arm 54 may comprise the protruding spot 56 to be in contact with the inner wall of the shell body 111; alternatively, the inner wall of the shell body 111 may comprise the contact structure 18 to be in contact with the extension arm 54. According to different needs or requirements, different structures may be applied to allow the firm contact between the grounding plate 5 and the metallic shell 11.

Please refer to FIGS. 2 and 3. In this embodiment, the grounding plate 5 comprises a plurality of through holes 511 formed on the surface of the plate body 51. In the insert-molded procedure of the third portion 27, plastic materials may flow through the through holes 511, so that the plastic materials may be spread over the grounding plate 5 quickly. Hence, the molding time of the third portion 27 can be shortened.

Please refer to FIGS. 2 and 3. In this embodiment, the grounding plate 5 further comprises an engaging hole 58 formed on the back of the plate body 51. The second portion 26 further comprises an engaging block 261, and the engaging block 261 is protruding from the surface of the second portion 26. When the second portion 26 is assembled to the bottom surface of the third portion 27, the engaging block 261 is engaged in the engaging hole 58. Therefore, the third portion 27 can be positioned further well with the second portion 26. Consequently, when the electrical receptacle connector 100 is mated with an electrical plug connector (even with frequent plug-in/plug-off), the third portion 27 (i.e., the tongue portion 22) would not get loose from the second portion 26 easily.

Please refer to FIGS. 2, 3, and 10. In this embodiment, the grounding plate 5 further comprises a shielding plate 512. The shielding plate 512 is integrally formed with the plate body 51. The shielding plate 512 is extending downward from an edge of the rear of the plate body 51. The shielding plate 512 is between the first tail portions 316 and the second tail portions 416. Since the shielding plate 512 shields the first tail portions 316 from the second tail portions 416, the signal interference between the first receptacle terminals 31 and the second receptacle terminals 41 can be prevented.

Please refer to FIGS. 2, 3, 8, and 10. In this embodiment, each of the conductive sheets 6 is at the insulated housing 2. Specifically, the conductive sheets 6 are at the first surface 221 and the second surface 222 of the tongue portion 22. From a front view of each of the conductive sheets 6, the conductive sheet 6 is a widen U-shape piece. In addition, the conductive sheets 6 have identical structures and symmetrical with each other.

Please refer to FIGS. 2, 3, 7, and 10. Each of the conductive sheets 6 comprises a flat plate 61, protruding portions 64, buckle arms 65, and contact arms 62. The flat plates 61 cover the two surfaces (i.e., the first surface 221 and the second surface 222) of the tongue portion 22. The protruding portions 64 are extending bilaterally and outward from the flat plate 61. Specifically, the number of the protruding portions 64 equals to the number of the ground terminals 313, 413. In addition, the buckle arms 65 are extending bilaterally from the flat plate 61 toward the tongue portion 22, and the buckle arms 65 are near to the protruding portions 64. The contact arms 62 are extending from two sides of the top of the flat plate 61 and extending toward the inner wall of the shell body 111. The contact arms 62 cover on the top of the base portion 21.

Please refer to FIGS. 2, 3, 7, and 10. In this embodiment, the insulated housing 2 further comprises a plurality of recessed holes 28 and a plurality of buckle holes 29. The recessed holes 28 are formed on the two surfaces of the tongue portion 22. Specifically, the recessed holes 28 are formed on the first portion 25 and the second portion 26. The buckle holes 29 are formed on the two surfaces of the tongue portion 22 and near to the recessed holes 28, respectively. In this embodiment, the buckle holes 29 are formed on the first portion 25, the second portion 26, and the third portion 27. The position of the recessed holes 28 at the first surface 221 of the tongue portion 22 corresponds to the position of the body portions 317 of the ground terminals 313 of the first receptacle terminals 31, and the number of the recessed holes 28 at the first surface 221 of the tongue portion 22 equals to the number of the ground terminals 313. Likewise, the position of the recessed holes 28 at the second surface 222 of the tongue portion 22 corresponds to the position of the body portions 417 of the ground terminals 413 of the second receptacle terminals 41, and the number of the recessed holes 28 at the second surface 222 of the tongue portion 22 equals to the number of the ground terminals 413.

Please refer to FIGS. 2, 3, 8, and 10. In this embodiment, the protruding portions 64 are received in the recessed holes 28, respectively. The protruding portions 64 at the first surface 221 of the tongue portion 22 are in contact with the body portions 317 of the ground terminals 313 of the first receptacle terminals 313, and the protruding portions 64 at the second surface 222 of the tongue portion 22 are in contact with the body portions 417 of the ground terminals 413 of the second receptacle terminals 41. Therefore, the conductive sheets 6 are respectively in contact with the ground terminals 313 of the first receptacle terminals 31 and the ground terminals 413 of the second receptacle terminals 41 for conduction purpose. The buckle arms 65 are received in the buckle holes 29, and the buckle arms 65 at two sides of the tongue portion 22 are in contact with the plate body 51 of the grounding plate 5, so that the conductive sheets 6 are in contact with the grounding plate 5 for conduction purpose. The contact arms 62 are in contact with the inner wall of the shell body 111, so that the conductive sheets 6 are in contact with the metallic shell 11 for conduction purpose.

When an electrical plug connector is mating with the electrical receptacle connector 100, the front of the metallic shell of the electrical plug connector is in contact with the conductive sheets 6, so that the metallic shell of the electrical plug connector is in contact with the metallic shell 11 of the electrical receptacle connector 100. Accordingly, the conductive sheets 6 can be provided for conduction, grounding, and reducing the electromagnetic interference.

Please refer to FIGS. 12 to 15, illustrating an electrical receptacle connector 100 according to a second embodiment of the instant disclosure. In the second embodiment, the cover plate 15 and the outer shell 122 are formed integrally as a whole; while in the first embodiment, the cover plate 15 and the outer shell 122 are separated pieces. In this embodiment, the cover plate 15 is extending downward from one side of the outer shell 122 and covering the rear opening of the tubular member 14. In addition, the cover plate 15 comprises an opening region 152, and the opening region 152 is recessed from the bottom of the cover plate 15 to expose the hollowed region 16. In other words, two legs 151 are extending from two sides of the bottom of the cover plate 15, and the two legs 151 and the middle of the bottom of the cover plate 15 define the opening region 152. Moreover, the opening region 152 is the hollowed region 16. Therefore, the tail portions 316 of the first receptacle terminals 31 can be checked through the opening region 152.

In this embodiment, each of the ground contacts 92 of the circuit board 9 is a soldering pad 922, and each of the legs 151 is abutting against the surface of the corresponding soldering pad 922 and in contact with the corresponding soldering pad 922. Specifically, each of the terminal contacts 91 of the circuit board 9 is an elongate soldering pad 911, and the elongate soldering pads 911 are exposed out of the opening region 152. Accordingly, the soldering condition between the tail portions 316 of the first receptacle terminals 31 and the terminal contacts 91 can be checked. Therefore, the soldering procedure can be redone when soldering spots are not applied to the terminal contacts 91 and the tail portions 316 properly, for example, if the tail portions 316 of the first receptacle terminals 31 and the terminal contacts 91 of the circuit board 9 are not firmly in contact with each other, or if the soldering spots between the tail portions 316 of the first receptacle terminals 31 are merged together to cause short circuit.

As above, the lengthened grounding plate improves the shielding performance and the structural strength of the tongue portion. In addition, the extension arms are in contact with the inner wall of the metallic shell to provide grounding and to reduce the electromagnetic interference (EMI). Moreover, because the contact arms of the conductive sheets are in contact with the inner wall of the metallic shell, the front of the metallic shell of an electrical plug connector is in contact with the conductive sheets when the electrical plug connector is mated with the electrical receptacle connector, so the metallic shell of the electrical plug connector is in contact with the metallic shell of the electrical receptacle connector. Accordingly, the connector can be effectively grounded through the conductive sheets, and the electromagnetic interference is reduced.

In addition, the cover plate is at one side of the metallic shell, and the hollowed region corresponds to the cover plate. Accordingly, the soldering condition between the first receptacle terminals and the circuit board can be checked from the hollowed region.

Moreover, the protruding portions of the conductive sheets are in contact with the ground terminals of the first and second receptacle terminals, the buckle arms of the conductive sheets are in contact with the grounding plate, and the contact arms are in contact with the inner wall of the metallic shell. Therefore, the conductive sheets, the grounding plate, and the metallic shell can be conducted, grounded, and the electromagnetic interference can be reduced.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180 degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

a metallic shell, comprising a shell body and a receptacle cavity defined in the shell body;

an insulated housing received in the receptacle cavity of the metallic shell, wherein the insulated housing comprises a base portion, a tongue portion, a plurality of recessed holes, and a plurality of buckle holes, the tongue portion is extending from one side of the base portion, wherein the insulated housing comprises a first portion and a second portion, the first portion is disposed on a top surface of the second portion, the first portion and the second portion are combined to form the base portion and the tongue portion, wherein the recessed holes are formed on two surfaces of the tongue portion, the buckle holes are formed on the two surfaces of the tongue portion and near to the recessed holes;

a plurality of first receptacle terminals held at the insulated housing;

a plurality of second receptacle terminals held at the insulated housing;

a grounding plate at the insulated housing, wherein the grounding plate comprises a plate body between the first receptacle terminals and the second receptacle terminals; and a plurality of conductive sheets at the insulated housing, wherein each of the conductive sheets comprises a flat plate, a protruding portion, a buckle arm, and a contact arm, the flat plates cover the two surfaces of the tongue portion, each of the protruding portions is extending laterally and outward from the corresponding flat plate and extending toward the corresponding recessed hole, the protruding portion at a first surface of the two surfaces of the tongue portion is in contact with the first receptacle terminals, and the protruding portion at a second surface of the two surfaces of the tongue portion is in contact with the second receptacle terminals, each of the buckle arms is extending laterally and outward from the corresponding flat plate and extending into the corresponding buckle hole, each of the buckle arms is in contact with the plate body of the grounding plate, each of the contact arms is extending from a top of the corresponding flat plate and in contact with an inner wall of the shell body.

2. The electrical receptacle connector according to claim 1, wherein the grounding plate comprises a plurality of through holes formed on the plate body.

3. The electrical receptacle connector according to claim 1, wherein the insulated housing further comprises a third portion disposed between the first portion and the second portion, the third portion forms the tongue portion, and wherein the first portion, the second portion, and the third portion are combined to form the base portion and the tongue portion, the grounding plate is disposed at the third portion, the recessed holes are formed on the first portion and the second portion, the buckle holes are formed on the first portion, the second portion, and the third portion.

4. The electrical receptacle connector according to claim 3, wherein the grounding plate comprises an engaging hole formed on the plate body, wherein the second portion comprises an engaging block engaged in the engaging hole.

5. The electrical receptacle connector according to claim 1, wherein the grounding plate comprises a shielding plate extending from an edge of the plate body, and the shielding plate is between the first receptacle terminals and the second receptacle terminals.

6. The electrical receptacle connector according to claim 1, wherein the grounding plate comprises a plurality of hooks extending from two sides of the front of the plate body and protruding out of two sides of the tongue portion.

7. The electrical receptacle connector according to claim 1, wherein the metallic shell comprises a cover plate covering one side of the shell body, wherein the cover plate comprises a plurality of legs, and the legs are extending from the bottom of the cover plate.

8. The electrical receptacle connector according to claim 7, wherein the metallic shell comprises a hollowed region, the hollowed region is formed at one side of the shell body, wherein when the cover plate is at an open position, the hollowed region is exposed, and wherein when the cover plate is at a close position, the cover plate is inserted into the shell body from the top to the bottom.

9. The electrical receptacle connector according to claim 8, wherein the shell body comprises a tubular member, the receptacle cavity is formed in the tubular member for receiving the insulated housing.

10. The electrical receptacle connector according to claim 9, wherein the cover plate is extending from one side of the metallic shell and covers an opening of the tubular member, and wherein the cover plate comprises an opening region recessed from a bottom thereof.

11. The electrical receptacle connector according to claim 9, wherein the metallic shell comprises a plurality of buckle pieces respectively extending from two sides of the rear of the tubular member, two sides of the cover plate are respectively buckled with the buckle pieces to cover the hollowed region.

12. The electrical receptacle connector according to claim 9, wherein the shell body comprises an outer shell enclosing the tubular member.

13. The electrical receptacle connector according to claim 12, wherein the metallic shell comprises a plurality of buckle pieces respectively extending from two sides of the rear of the outer shell, two sides of the cover plate are respectively buckled with the buckle pieces to cover the hollowed region.

14. The electrical receptacle connector according to claim 9, further comprising a circuit board, wherein the circuit board comprises a plurality of terminal contacts and a plurality of ground contacts, the terminal contacts correspond to the hollowed region and are soldered with the first receptacle terminals, the legs of the cover plate are connected to the ground contacts, respectively.

15. The electrical receptacle connector according to claim 14, wherein each of the ground contacts is a connecting hole, each of the legs is inserted into the corresponding connecting hole to be in contact with an inner wall of the corresponding connecting hole.

16. The electrical receptacle connector according to claim 14, wherein each of the terminal contacts is an elongated soldering pad, the first receptacle terminals are in contact with the elongated soldering pads, respectively.

17. The electrical receptacle connector according to claim 1, wherein the first receptacle terminals and the second receptacle terminals have 180 degree symmetrical design with respect to a central point of the receptacle cavity as the symmetrical center.

* * * * *